US011773331B2

(12) United States Patent
Timko et al.

(10) Patent No.: US 11,773,331 B2
(45) Date of Patent: Oct. 3, 2023

(54) ETHANOL DERIVED PETROCHEMICALS

(71) Applicant: Worcester Polytechnic Institute, Worcester, MA (US)

(72) Inventors: Michael T. Timko, Arlington, MA (US); Geoffrey A. Tompsett, Shrewsbury, MA (US); Azadeh Zaker, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 17/713,818

(22) Filed: Apr. 5, 2022

(65) Prior Publication Data

US 2022/0325184 A1 Oct. 13, 2022

Related U.S. Application Data

(60) Provisional application No. 63/172,307, filed on Apr. 8, 2021.

(51) Int. Cl.
*C10G 1/08* (2006.01)
*C10G 1/06* (2006.01)

(52) U.S. Cl.
CPC ..... *C10G 1/086* (2013.01); *C10G 1/065* (2013.01); *C10G 1/083* (2013.01); *C10G 2300/805* (2013.01)

(58) Field of Classification Search
CPC .... H04B 7/0413; H04B 7/0805; H04B 7/088; H04L 25/067; H04W 28/02; H04W 72/04; H04W 74/00; H04W 74/0816; H04W 74/006; H04W 74/008; C10G 1/065; C10G 1/083; C10G 1/086; C10G 2300/805
See application file for complete search history.

(56) References Cited

U.S. PATENT DOCUMENTS 6,506,954 B1 * 1/2003 Brown ..... C07C 15/08 585/634
2008/0183676 A1 8/2008 Anderson et al.
2016/0186077 A1 6/2016 Yao et al.
2018/0258353 A1 9/2018 Choi et al.
2019/0264113 A1 8/2019 Choi

FOREIGN PATENT DOCUMENTS

CN 102676201 A 9/2012
WO WO-2008034109 A1 * 3/2008 ..... C11C 3/003

OTHER PUBLICATIONS

International Search Report, PCT/US2022/023498, dated Jul. 25, 2022, pp. 1-4.

* cited by examiner

*Primary Examiner* — Ellen M McAvoy
*Assistant Examiner* — Chantel L Graham
(74) *Attorney, Agent, or Firm* — Armis IP Law, LLC

(57) ABSTRACT

Methods are described herein for upgrading ad refining hydrocarbons, and producing at least one petrochemical product, the method including: preparing a reaction mixture by adding at least two of: a quantity of bioethanol, a quantity of hydrocarbon, and a quantity of water to a reactor containment; combining the reaction mixture with a quantity of catalyst in the reactor containment; applying reaction conditions to the reactor containment thereby generating supercritical conditions for the reaction mixture and obtaining a product mixture; and extracting at least one petrochemical product from the product mixture.

14 Claims, 10 Drawing Sheets

ETHANOL DERIVED PETROCHEMICALS

RELATED APPLICATION

This application claims priority to U.S. provisional application No. 63/172,307 filed Apr. 8, 2021, entitled "Ethanol Derived Petrochemicals" by inventors Michael T. Timko, Geoffrey A. Tompsett, and Azadeh Zaker, which is hereby incorporated by reference herein in its entirety.

BACKGROUND

Global annual production of ethanol has increased by 3.8% between 2016 and 2017. The leaders of ethanol production are United States and Brazil, together account for 84% of global population in 2017. Both countries have invested in using blends of ethanol and gasoline as fuel in motor vehicles.

The use of fuel ethanol has been very successful in Brazil because ethanol can be produced at a very low costs by fermentation of sugarcane. However, in other countries having different amounts, costs, and characteristics of feedstocks, instead of using bioethanol for transportation fuel purposes which has a relatively low value, using bioethanol as a precursor to produce other valuable petrochemical is beneficial. For example, compared to corn, which is the main ethanol biomass feedstock in U.S., sugarcane which is the dominant biomass source in Brazil has about 30% greater concentration of sucrose and therefore, easier to extract. In addition to the economic aspects, bioethanol reduces the world's need for diminishing fossil resources, which are currently the main feedstocks for chemical production.

A common valorization practice for the increasing production of bioethanol is direct blending of bioethanol with gasoline fuel. High concentration of ethanol containing fuel (e.g. E85) has been available for several years. However, for gasoline blend applications, between 5-15% vol of ethanol content is preferred since high ethanol content fuel has some incompatibilities with conventional automobile engines for example, components that brittle with time and disintegrate in the presence of alcohol. Therefore, the high ethanol gasoline blend is used in flex-fuel vehicles only. As a result, the ethanol market is at a saturation point in United States transportation sector and there is an opportunity for the excess ethanol to be used as a feedstock to produce commodity chemicals such as ethylene, C3-C4 olefins, butanol, butadiene, and gasoline. In addition to these chemicals, there are limited reports on benzene, toluene, and xylenes (BTX) production from bio-derived ethanol.

BTX compounds are widely used in chemical and petrochemical industries as octane-booster gasoline additives, solvents, building blocks in production of polyesters, plastics, detergents, pharmaceuticals, agricultural products and explosive chemicals. Global consumption of toluene and xylene in 2015 was estimated at 23 and 52 metric tons which is expected to grow by 22% and 25% respectively in 2020. BTX is obtained by naphtha pyrolysis and catalytic reforming of fossil fuel or pyrolysis and upgrading of low value feedstocks such as bitumen.

Bioethanol is obtained from biomass through fermentation and is a broth with low percentages of ethanol (about 10 wt %). The broth is subsequently distilled to produce hydrated ethanol (about 93 wt %). Other separation methods such as extractive separation are required for further dehydration because water and ethanol form an azeotrope with concentration of 95.6 wt % ethanol at 1 atm. Therefore, ethanol purification is an energy intensive process.

There is a need for an energy efficient method for production of petrochemical products such as BTX (benzene, toluene, xylenes) and branched alkanes from simultaneous dehydration of bioethanol and crude oil.

SUMMARY

An aspect of the invention described herein provides a method for producing at least one petrochemical product, the method including: preparing a reaction mixture by adding at least two of: a quantity of bioethanol, a quantity of hydrocarbon, and a quantity of water to a reactor containment; combining the reaction mixture with a quantity of catalyst in the reactor containment; applying reaction conditions to the reactor containment thereby generating supercritical conditions for the reaction mixture and obtaining a product mixture; and extracting at least one petrochemical product from the product mixture.

An embodiment of the method further includes removing from the reactor containment at least one residual product. In an embodiment of the method, the residual product includes at least one of: water, catalyst, and unreacted hydrocarbon. An embodiment of the method further includes reusing the residual product for subsequent reaction. In an embodiment of the method, the reaction conditions result in reducing formation of coke compared to a reaction not including water or ethanol. In an embodiment of the method, the petrochemical product includes aromatic products and aliphatic products.

In an embodiment of the method, the aromatic products are selected from: benzene, toluene, ethylbenzene, xylene, $C_9$ aromatic products, $C_{10}$ aromatic products, $C_{11}$ aromatic products, $C_{12}$ aromatic products, and alkyl-naphthalene. In some embodiments, the aliphatic products are selected from: n-alkane, n-alkene, b-alkane, b-alkene, cyclo-alkane, and cyclo-alkene.

In some embodiments of the method, the catalyst is a zeolite catalyst. In some embodiments, the zeolite catalyst is at least one selected from: Zeolite Socony Mobil-5 (ZSM-5), nano-ZSM-5, zeolite Y, zeolite β, mordenite, $Fe_2O_3$ (HY), ferrierite and MCM-22. In an embodiment of the method, the quantity of the catalyst is selected from 1.0 wt % to 2.0 wt %, 2.0 wt % to 3.0 wt %, 3.0 wt % to 4.0 wt %, 4.0 wt % to 5.0 wt %, 5.0 wt % to 6.0 wt %, 6.0 wt % to 7.0 wt %, 7.0 wt % to 8.0 wt %, 8.0 wt % to 9.0 wt %, and 9.0 wt % to 10.0 wt %.

In an embodiment of the method, the quantity of bioethanol is selected from: 1.0 wt % to 2.0 wt %, 2.0 wt % to 3.0 wt %, 3.0 wt % to 4.0 wt %, 4.0 wt % to 5.0 wt %, 5.0 wt % to 6.0 wt %, 6.0 wt % to 7.0 wt %, 7.0 wt % to 8.0 wt %, 8.0 wt % to 9.0 wt %, and 9.0 wt % to 10.0 wt %. In some embodiments of the method, the quantity of water is selected from: 1.0 wt % to 2.0 wt %, 2.0 wt % to 3.0 wt %, 3.0 wt % to 4.0 wt %, 4.0 wt % to 5.0 wt %, 5.0 wt % to 6.0 wt %, 6.0 wt % to 7.0 wt %, 7.0 wt % to 8.0 wt %, 8.0 wt % to 9.0 wt %, and 9.0 wt % to 10.0 wt %.

In an embodiment of the method, the reaction conditions result in higher quantity of petrochemical products compared to a reaction not including water or ethanol. In some embodiments of the method, the reaction conditions result in lower quantity of unreacted hydrocarbon compared to a reaction not including water or ethanol.

An aspect of the invention described herein provides a method for upgrading hydrocarbon feedstock to produce at least one petrochemical product, the method including:

preparing a reaction mixture by adding 5 wt % bioethanol, 90 wt % hydrocarbon, and 5 wt % water to a reactor containment; combining the reaction mixture with 5 wt % catalyst selected from ZSM-5 or nano-ZSM-5 in the reactor containment; applying reaction conditions to the reactor containment thereby generating supercritical conditions for the reaction mixture and obtaining a product mixture; and extracting at least one petrochemical product from the product mixture.

In an embodiment of the method, the petrochemical product is at least one selected from: benzene, toluene, ethylbenzene, xylene, $C_9$ aromatic products, $C_{10}$ aromatic products, $C_{11}$ aromatic products, $C_{12}$ aromatic products, and alkyl-naphthalene.

An aspect of the invention described herein provides a method for producing at least one petrochemical product selected from: benzene, toluene, xylene, and ethylbenzene; the method including: preparing a reaction mixture by adding 5 wt % bioethanol, 90 wt % hydrocarbon, and 5 wt % water to a reactor containment; combining the reaction mixture with 5 wt % catalyst selected from ZSM-5 or nano-ZSM-5 in the reactor containment; applying reaction conditions to the reactor containment thereby generating supercritical conditions for the reaction mixture and obtaining a product mixture; and extracting at least one petrochemical product from the product mixture.

DETAILED DESCRIPTION

Figure 1:
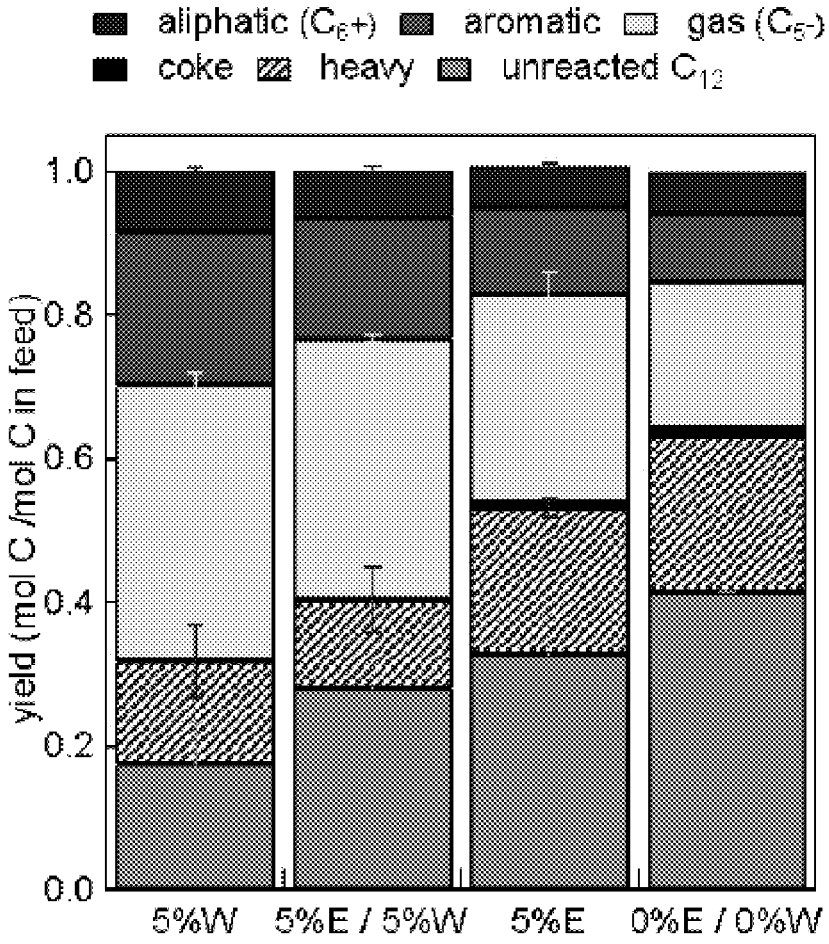
FIG. 1 is a stacked bar graph demonstrating product molar yields obtained from dodecane cracking reaction in the presence of 5 wt % Super critical water (SCW) and 95 wt % dodecane (5% W); 5 wt % ethanol, 5 wt % water, and 90 wt % dodecane (5% E/5% W); 5 wt % ethanol and 95 wt % dodecane (5% E); and 100 wt % dodecane. The aliphatic products are at the top of the bar graph, followed by aromatic products, followed by aliphatic gas products less than C5, followed by heavy oil, unreacted C12. The reactions were conducted at 400° C., 24±2 MPa, 5 wt % commercial ZSM-5 catalyst loading relative to initial dodecane plus ethanol mass, 0.25 h reaction time.

The use of supercritical water (SCW) for upgrading petroleum and alternative feedstocks has several advantages compared to hydrotreating and slow coking. Supercritical water upgrading (SCWU) is a pyrolytic process that is performed in the presence of dense, near-critical water or supercritical water. At these conditions, many components of crude oil or other hydrocarbon feedstocks are miscible with water, eliminating mass transport resistances between phases. Further, the presence of supercritical water minimizes bimolecular recombination reactions that result in coke formation; as such, SCWU of fossil feeds like bitumen or crude oil minimize catalyst deactivation and the rejection of carbon rejection as a low value solid by-product. Operating in a regime where crude oil and water are partially or fully miscible provides alternative pathways for crude oil desulfurization. Specifically, supercritical water has been shown to react with sulfur compounds, preventing their re-combination to form coke, removing sulfur as H2S, and decreasing the demand for excess hydrogen in conventional upgrading techniques.

Addition of a catalyst promotes desulfurization of thiophenic compounds without addition of hydrogen. Finally, specific to renewable feedstocks, biomass, agricultural residues, food waste, and microalgae all contain significant quantities of water (>50 wt %); as such, directly processing these feeds in the presence of SCW eliminates the need for energy intensive drying steps. Therefore, SCW processing results in environmental and economic benefits.

The focus of SCWU has been production of fuels, especially from heavy crude oils or bitumen. For example, SCWU is used in vacuum residue to produce gasoline, diesel, and vacuum gas oil range components with minimal carbon rejection as coke, as is observed for the similar process of slow coking. In addition to fuel production, production of benzene-toluene-ethyl benzene-xylene product (BTX) is observed, with maximum yields varying from 0.015 (benzene) to 2 wt % (xylenes and ethyl benzene combined).

BTX compounds are more valuable than refined fuels, making them an especially important co-product, especially in a more decarbonized future. However, aromatic compounds are an intermediate in the formation of coke, and coke production is undesirable due to its low value. The methods described herein demonstrate that SCW allows BTX formation and suppresses coke formation. Further, addition of aromatization catalysts to the SCW greatly increases the BTX yield compared to the BTX yield obtained under non-catalytic SCWU conditions. It is here envisioned that super critical water suppresses formation of multi-ring aromatic compounds and coke.

ZSM-5 has maximum pore diameters, as quantified by the ring atoms Norman radii (dN), which confer shape selectivity for formation of monocyclic aromatics such as toluene, ethylbenzene and xylene. Despite the aggressive conditions of SCW and the failure of most zeolites to retain sufficient stability to act catalytically, ZSM-5 catalyzes hydrocarbon cracking and aromatization in SCW.

Utilizing catalysts in the presence of liquid or dense supercritical water is challenging due to lack of stability of the catalyst. Zeolite degradation in SCW may be associated with both ion content and dielectric constant. Therefore, it is here envisioned that mixtures consisting primarily of hydrocarbons, with water present only as a minor component, may prove less aggressive than undiluted SCW. Improved stability is a crucial factor in commercial applications because rapid catalyst deactivation is costly.

Ethanol dehydration to ethylene has been extensively studied over a variety of heterogeneous catalysts including alumina, zeolites, and transition metal oxides, among which γ-alumina and zeolites are most common catalysts for their high activity and selectivity. Performing zeolite catalyzed ethanol dehydration reactions at elevated temperatures (>400° C.) favors secondary reactions (e.g., oligomerization, cracking, alkylation, and aromatization) to produce valuable chemicals. Since bioethanol, which is obtained from biomass through fermentation, is a broth containing ethanol and water, hot liquid water-assisted upgrading technologies are useful to eliminate the energy intensive separation processes as well as benefiting from water effects on suppressing coke formation.

Catalyst stability is one of the main concerns in using hydrothermal conditions for ZSM-5 catalyzed ethanol dehydration reaction. Even with 0% water content in the feed composition, since water is one of the products of ethanol dehydration reaction, the catalyst stability remains one of the concerns for high conversion systems.

Figure 4:
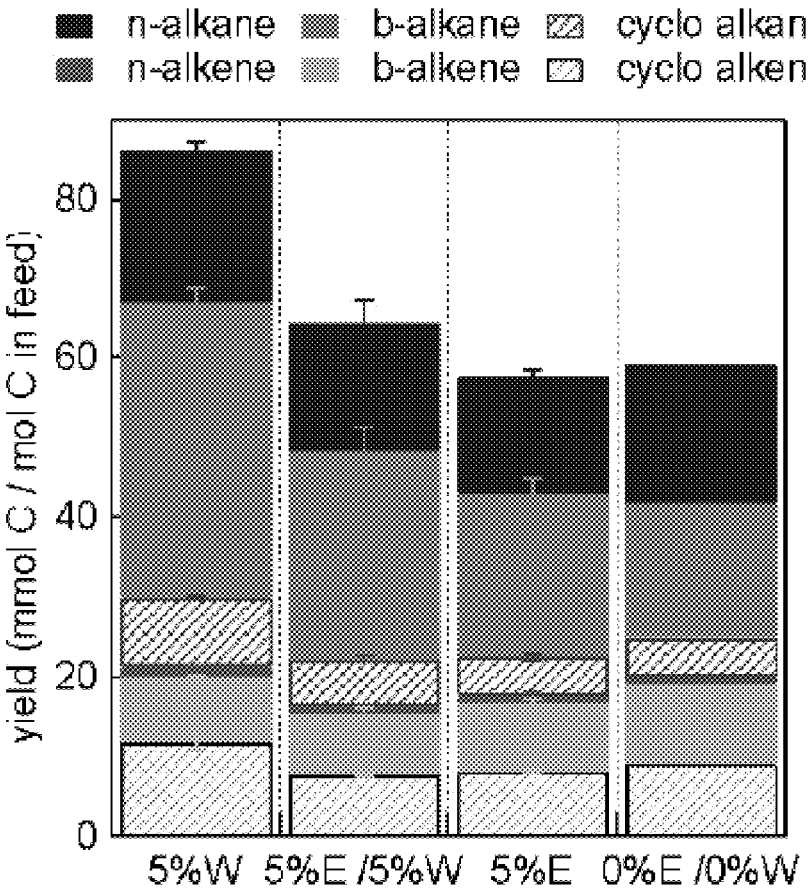
FIG. 4 is a stacked bar graph showing the distribution of various alkane and alkene products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol and 95 wt % dodecane (5% E); and 100 wt % dodecane. The top of the bar graph shows yield of n-alkanes, followed by b-alkanes, followed by cyclo-alkanes, next by n-alkene, followed by b-alkene, and finally cyclo-alkene.
Figure 8:
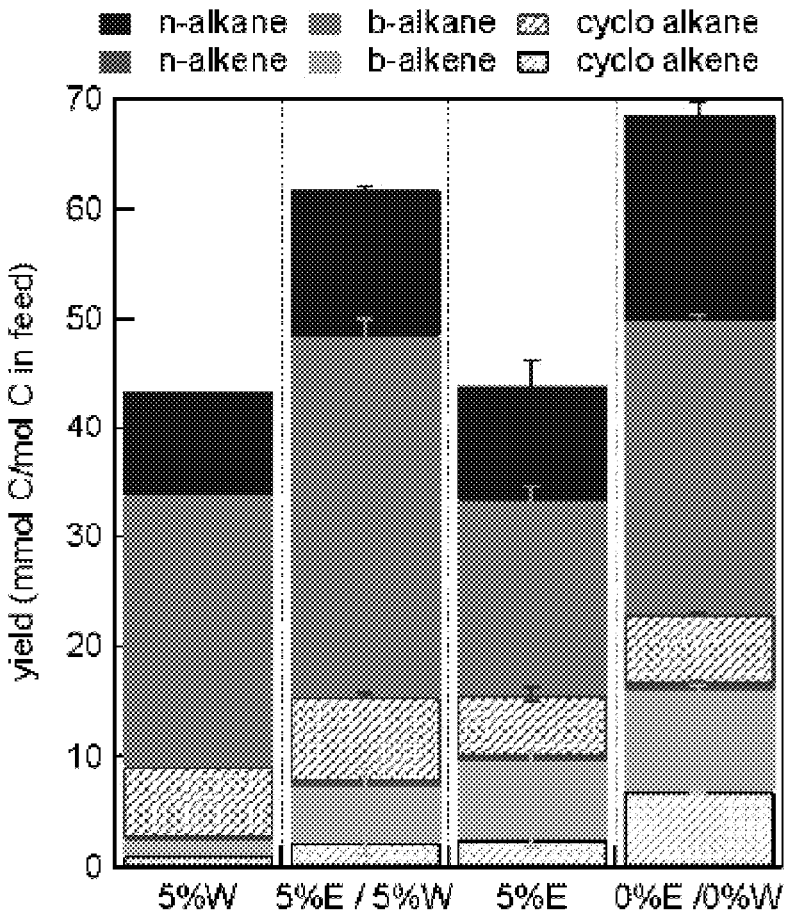
FIG. 8 is a stacked bar graph showing the distribution of various alkane and alkene products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol, and 95 wt % dodecane (5% E); and 100 wt % dodecane. The top of the bar graph shows yield of n-alkanes, followed by b-alkanes, followed by cyclo-alkanes, next by n-alkene, followed by b-alkene, and finally cyclo-alkene.

In the present invention, a solution of 5 wt % ethanol, 5 wt % water, and 90 wt % dodecane was treated under supercritical conditions at 400° C. and 24 MPa in presence of different zeolite catalyst structures which are 5 wt % of the hydrocarbon feedstock to form valuable chemical compounds including BTX and branched alkanes. See FIG. 4 and FIG. 8.

The methods described herein provide methods for producing valuable petrochemicals from renewable and traditional feedstocks using zeolite catalyzed bioethanol and fossil-based oil blends thereby obtaining fuels and chemicals in supercritical water. The methods eliminate or reduce the need for distillation processes to separate water from bioethanol and at the same time benefit from the water present in bioethanol, for supercritical cracking of fossil-based oil and formation of valuable products. In addition, the presence of water decreases coke formation on catalyst surface.

Figure 10:
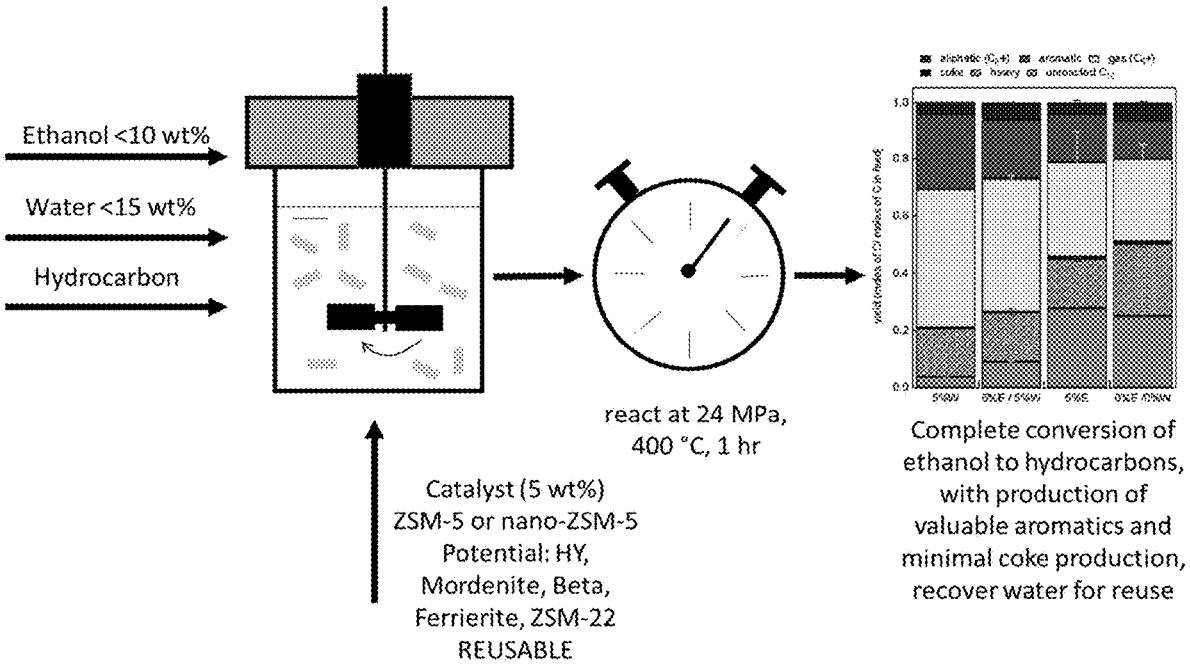
FIG. 10 is a schematic showing that reacting ethanol less than 10 wt %, SCW water less than 15 wt %, and a hydrocarbon in presence of a catalyst about 5 wt % for 1 hour at 24 MPa and at a temperature of 400° C. results in complete conversion of ethanol to hydrocarbons. Further, the reaction results in production of aromatics with minimal coke production. The water and the catalyst are recovered for reusing. The catalyst used is selected from ZSM-5, nano-ZSM-5, HY, Mordenite, Beta, Ferrierite, and ZSM-22.

Three different zeolites were analyzed for maximum selectivity of BTX products. The three zeolite catalysts observed were ZSM-22, ZSM-5, and nano-ZSM-5. Compared to ZSM-5 and nano-ZSM-5 were observed to produce 133 times more BTX compared to ZSM-22. Further, nano-ZSM-5 was observed to produce 1.3 times and 4.9 times more branched alkanes compared to ZSM-5 and ZSM-22 respectively. See FIG. 10.

In examples and methods described herein, a blend of ethanol and fossil-based oil is used as a feedstock and an initial 5 wt % water content, to produce valuable petrochemicals through ZSM-5 catalyzed upgrading under supercritical condition.

To assess the influence of SCW and ethanol on catalytic activity and selectivity of products, examples were performed using various mixtures of ethanol, water, and dodecane as depicted in Table I.

TABLE I

Mixtures of ethanol, water and dodecane by mass

| Feed | Ethanol | Water | Dodecane | Catalyst |
|---|---|---|---|---|
| 5% E/5% W | 5% | 5% | 90% | 5% |
| 5% W | 0% | 5% | 95% | 5% |
| 5% E | 5% | 0% | 95% | 5% |
| 0% E/0% W | 0% | 0% | 100% | 5% |

Zeolite to hydrocarbon feed (dodecane+ethanol) ratio was kept constant (5% by mass), and the reaction temperature, pressure and time were 400° C., 24±2 MPa, and 0.25 h respectively. The reactions were performed with both nano- ZSM-5 and ZSM-5 to measure the difference in conversions and selectivity for a diffusion-limited catalyst.

The effect of water content was analyzed with respect to BTX formation. In the examples described herein 5 wt % of water, 5 wt % ethanol and 95 wt % dodecane were reacted under same reaction conditions including temperature, pressure and quantity of zeolite catalyst. It was observed that ZSM-22 formed 6 times greater quantity of BTX products compared to ZSM-5 and nano-ZSN-5, each of which forms 0.6 times lower quantity of BTX products.

Figure 2:
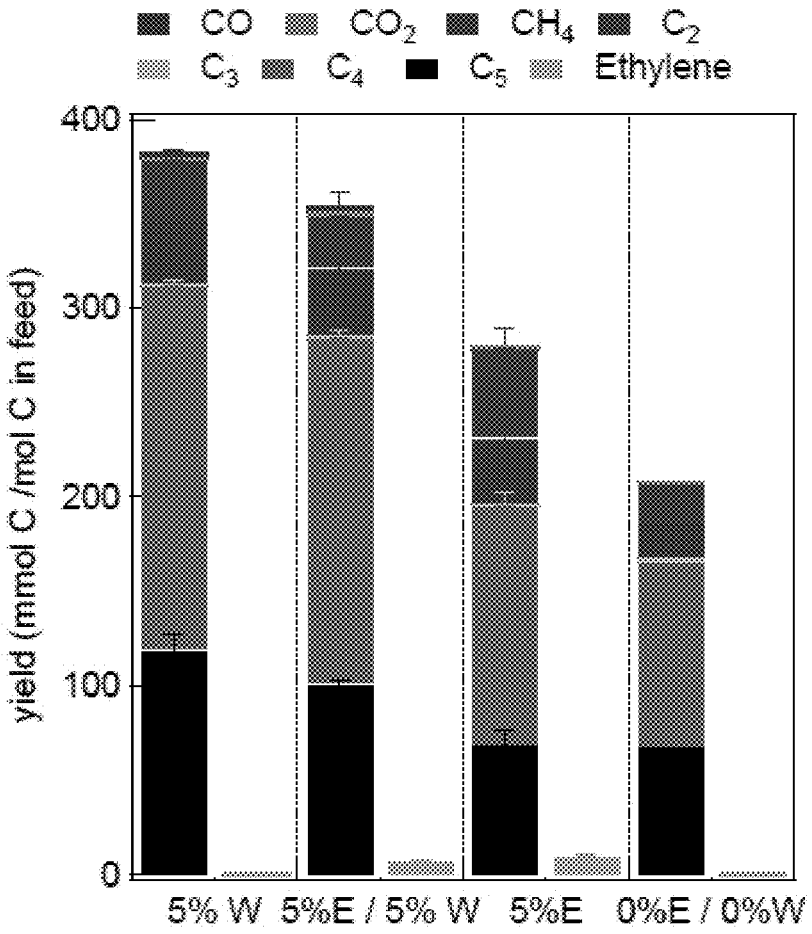
FIG. 2 is a stacked bar graph depicting molar yield of gas products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol and 95 wt % dodecane (5% E); and 100 wt % dodecane. The top of the bar graph show yield of carbon monoxide, followed by carbon dioxide, followed by methane, followed by $C_2$ gas such as ethane, then $C_3$ gas such as propane, then $C_4$ gas such as butanes, and followed by $C_5$ gases such as pentane. A separate bar shows the molar yield of ethylene for each of the mixtures.

The product molar yields obtained from dodecane cracking reaction were measured for each of the mixtures. The 5 wt % ethanol feed was observed to be completely converted to products. See FIG. 1. The feed having no ethanol content (5% W and 0% E/0% W), the selectivity of products to ethylene was observed to be negligible. Therefore, in feeds having ethanol content such as 5% E and 5% E/5% W the ethylene production can be attributed to the presence of ethanol. Accordingly, the selectivity of ethanol to ethylene product is 22% (molar) in 5% E/5% W and 31% (molar) in 5% E reaction. See FIG. 2.

TABLE II

Zeolite maximum pore diameters and aromatic compounds and water kinetic diameter

| Zeolite | Pore Diameters (Norman radii-$d_N$) Å | Compound | Kinetic diameter Å |
|---|---|---|---|
| ZSM-5 | 6.0 and 6.3 | Benzene, toluene, and p-xylene | 5.85 |
| ZSM-22 | 5.8 | Ethylbenzene | 6.0 |
| Zeolite Y | 8.1 | o-xylene and m-xylene | 6.8 |
| Zeolite β | 6.3 and 7.4 | Naphthalene | 6.2 |
| MCM-22 | 6.2 | Water | 3.0, cluster > 6.0 |

In addition to ethylene production, it was observed that addition of 5 wt % ethanol to the dodecane feed increased the aromatic production from 0.09 to 0.12 (mole C in product/mole C in feed) which is an increase by 33% compared to a dodecane feed. See FIG. 3. Addition of 5 wt % water to the ethanol/dodecane blend increased the aromatic formation from 0.12 to 0.17 (mole C in product/mole C in feed) which is an increase by 41% compared to ethanol/dodecane blend and an increase by 88% compared to a dodecane feed. However, comparatively, using 5 wt % water in the absence of ethanol was observed to have the greatest aromatic production of 0.21 (mole C in product/mole C in feed) which is an increase of 23% compared to water/ethanol/dodecane blend. Therefore, water has a significant effect in increasing aromatic formation if ethanol is not present in the system.

Compared to commercial ZSM-5, nano-ZSM-5 has less diffusion limitation for dodecane cracking reaction which may specifically affect aromatic product formation, since most of alkylated 1-ring aromatic compounds have similar molecular diameter as ZSM-5 pore diameter. See Table II. Therefore, to improve the catalyst activity toward valuable chemicals, nano-ZSM-5 was used in the same reaction conditions as commercial ZSM-5.

Figure 5:
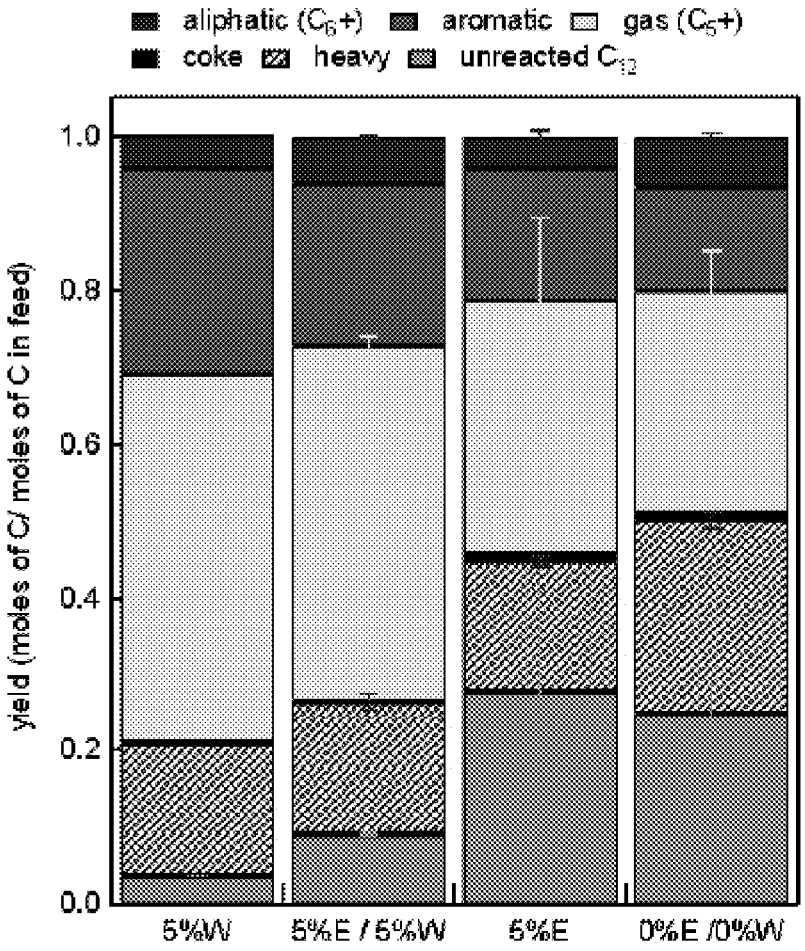
FIG. 5 is a stacked bar graph demonstrating product molar yields obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol, and 95 wt % dodecane (5% E); and 100 wt % dodecane. The aliphatic products are at the top of the bar graph, followed by aromatic products, followed by aliphatic gas products less than C5, followed by heavy oil, unreacted C12. The reactions were conducted at 400° C., 24±2 MPa, 5 wt % nano-ZSM-5 catalyst loading relative to initial dodecane plus ethanol mass, 0.25 h reaction time.
Figure 6:
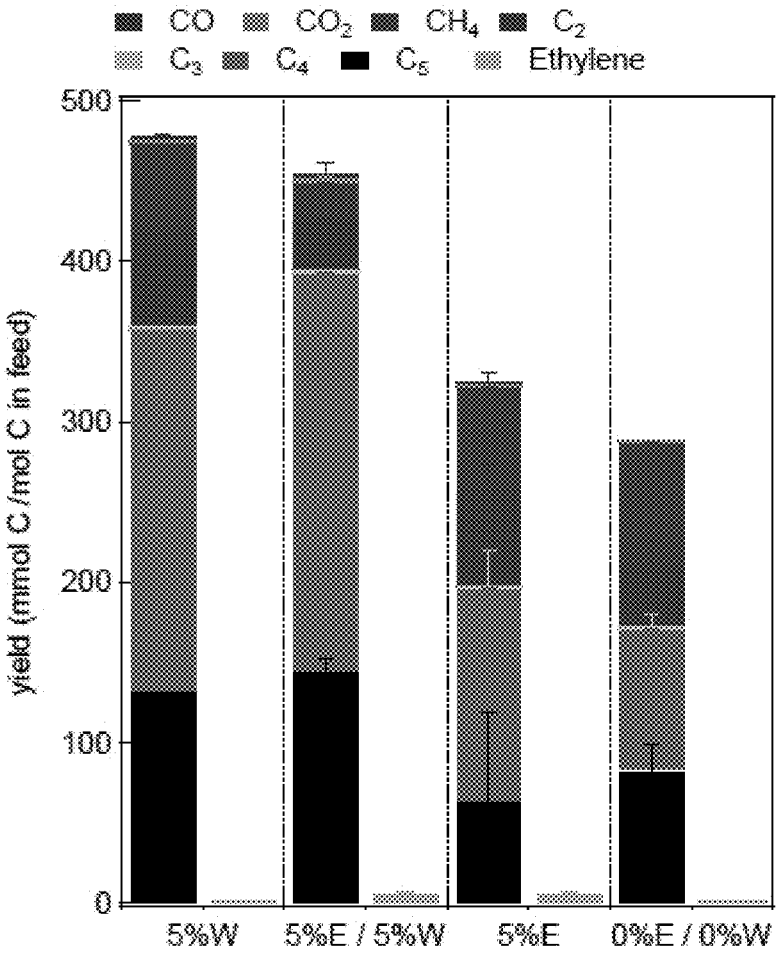
FIG. 6 is a stacked bar graph depicting molar yield of gas products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol, and 95 wt % dodecane (5% E); and 100 wt % dodecane. The top of the bar graph show yield of carbon monoxide, followed by carbon dioxide, followed by methane, followed by $C_2$ gas such as ethane, then $C_3$ gas such as propane, then $C_4$ gas such as butanes, and followed by $C_5$ gases such as pentane. A separate bar shows the molar yield of ethylene for each of the mixtures.

The product molar yields from dodecane cracking using the mixtures of Table I and catalyst nano-ZSM-5 were measured. See FIG. 5. The conditions were maintained at 400° C., 24±2 MPa, 5 wt % nano-ZSM-5 catalyst loading relative to initial dodecane plus ethanol mass, 0.25 h reaction time. The results from FIG. 5 show that compared to commercial ZSM-5, use of nano-ZSM-5 results in increased reaction conversions and increased aromatic yield by 35%. Similar to ZSM-5, the feed having no ethanol content (5% W and 0% E/0% W), the selectivity of products to ethylene was observed to be negligible. In feeds having ethanol content such as 5% E and 5% E/5% W the ethylene production can be attributed to the presence of ethanol. See FIG. 6.

Figure 9:
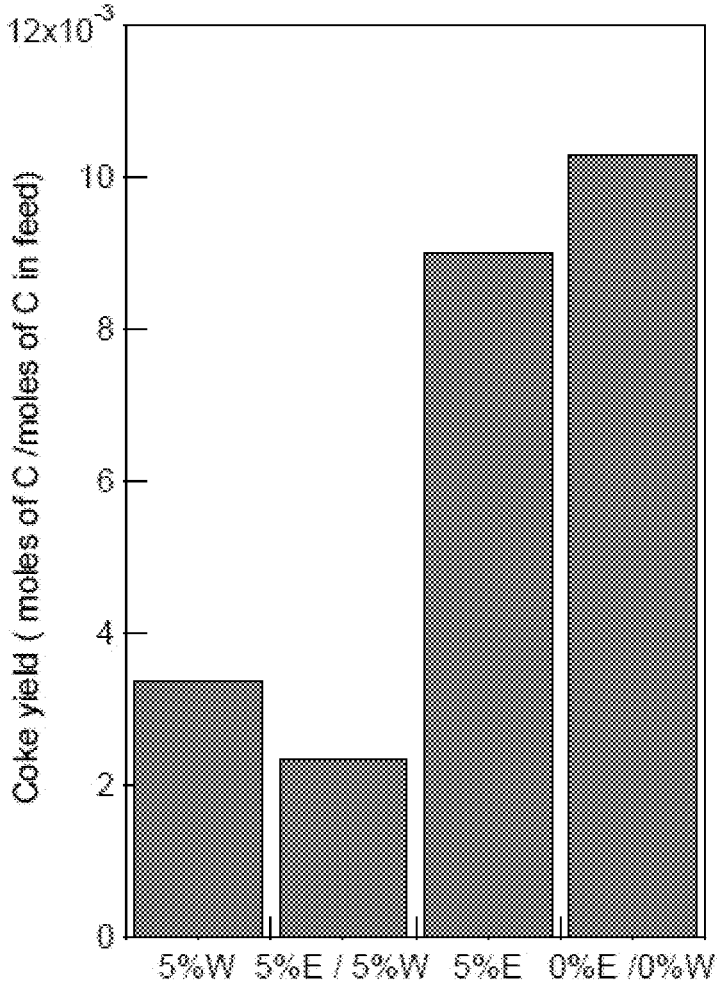
FIG. 9 is a bar graph showing molar yields of coke obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol, and 95 wt % dodecane (5% E); and 100 wt % dodecane. The reactions were conducted at 400° C., 24±2 MPa, 5 wt % nano-ZSM-5 catalyst loading relative to initial dodecane plus ethanol mass, 0.25 h reaction time.

Further, the coke formation was observed to have decreased by a factor of about four after addition of 5 wt % water (5% E/5% W) to the ethanol/dodecane (5% E) system using nano-ZSM-5 as the catalyst. See FIG. 9.

Figure 3:
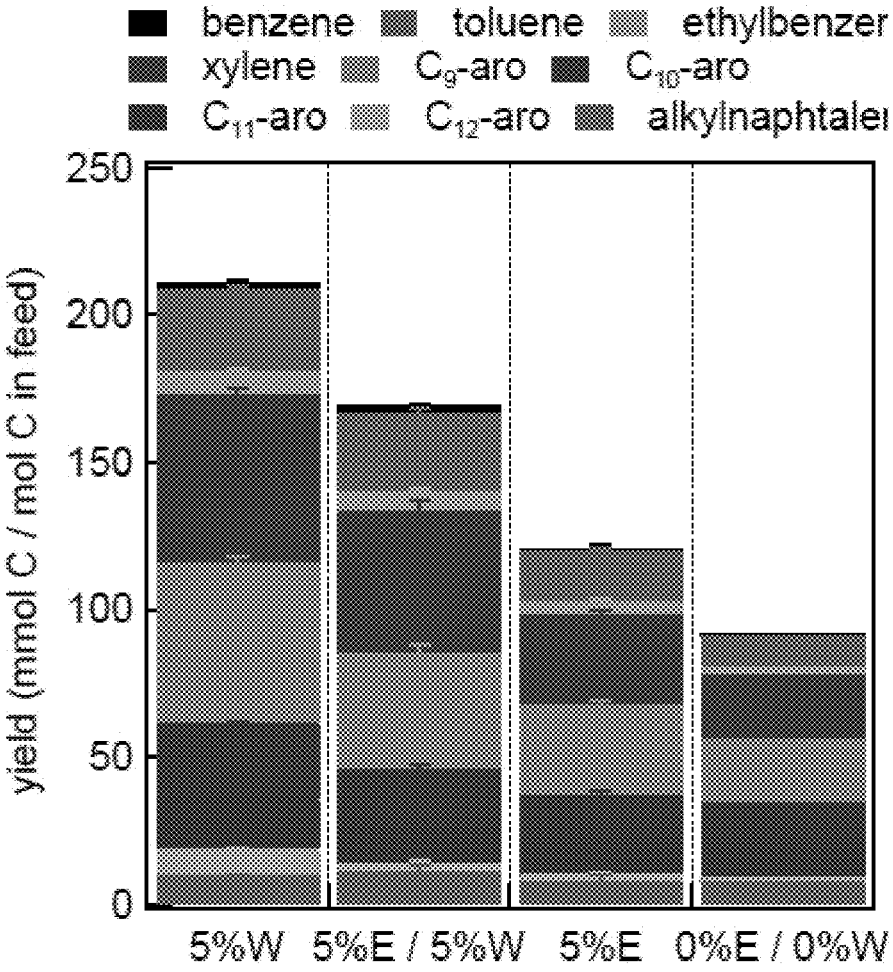
FIG. 3 is a stacked bar graph showing the distribution of various aromatic products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol and 95 wt % dodecane (5% E); and 100 wt % dodecane. The top of the bar graph shows yield of benzene, followed by toluene, then ethylbenzene, followed by xylene, followed by $C_9$ aromatic products, followed by $C_{10}$ aromatic products, followed by $C_{11}$ aromatic products, followed by $C_{12}$ aromatic products, and finally alkyl-naphthalene.
Figure 7:
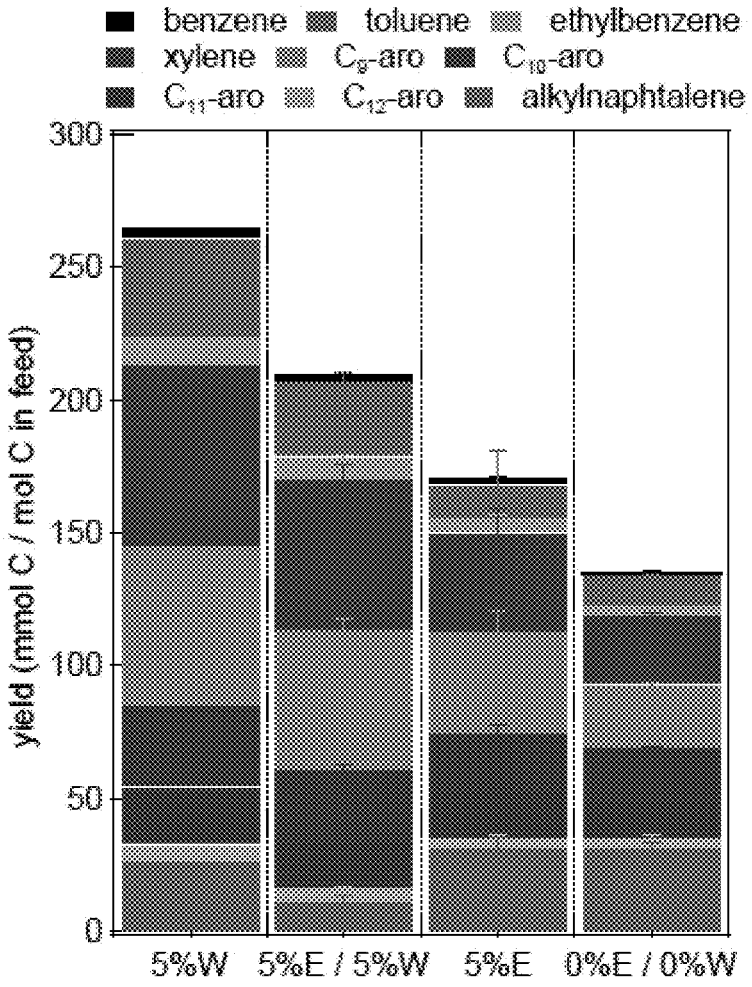
FIG. 7 is a stacked bar graph showing the distribution of various aromatic products obtained from dodecane cracking reaction in the presence of 5 wt % SCW and 95 wt % dodecane (5% W); 5 wt % ethanol, 5 wt % water, and 90 wt % dodecane (5% E/5% W); 5 wt % ethanol, and 95 wt % dodecane (5% E); and 100 wt % dodecane. The top of the bar graph shows yield of benzene, followed by toluene, then ethylbenzene, followed by xylene, followed by $C_9$ aromatic products, followed by $C_{10}$ aromatic products, followed by $C_{11}$ aromatic products, followed by $C_{12}$ aromatic products, and finally alkyl-naphthalene.

Detailed composition of aromatic products in FIG. 3 and FIG. 7 are observed to include 1-ring alkylated compounds without significant production of benzene. Therefore, the blend of the aromatic products is an ideal mixture to be used in gasoline pool as an octane booster.

The patent or application file contains at least one drawing executed in color. Copies of this patent or patent application publication with color drawing(s) will be provided by the Office upon request and payment of the necessary fee.

A portion of the embodiments herein were published Dec. 13, 2021, in a thesis entitled, "Supercritical Water Assisted Zeolite Catalyzed Upgrading of Hydrocarbons" by co-inventor Azadeh Zaker, which is incorporated by reference herein in its entirety.

The inventions described herein are the most practical methods. It is recognized, however, that departures may be made within the scope of the invention and that modifications will occur to a person skilled in the art. With respect to the above description then, it is to be realized that the optimum dimensional relationships for the parts of the invention, to include variations in size, materials, shape, form, function, steps, and manner of operation, assembly and use, would be apparent to one skilled in the art, and all equivalent relationships to those illustrated in the drawings and described in the specification are intended to be encompassed by the present inventions.

Therefore, the foregoing considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Such equivalents are within the scope of the present invention and claims. The contents of all references including issued patents and published patent applications cited in this application are hereby incorporated by reference.

The invention now having been fully described, it is further exemplified by the following examples and claims.

Example 1: Materials

Dodecane (Cl2H26, 99.5% purity) was purchased from TCI America. ZSM-5 was purchased from ACS Materials (p-38, Si/Al molar ratio equal to 38). Water was de-ionized (DI) to a resistivity of 18.1 MΩ·cm prior to use. Helium, air, and nitrogen (99.999% purity) were purchased from Airgas. Toluene (C6H5CH3, anhydrous 99.8%) and pyridine (C5H5N, 99%) were purchased from Sigma-Aldrich. Dichloromethane (CH2Cl2, 99.9%) was purchased from Fischer Chemical. Isopropylamine (C3H9N, 99%) was purchased from Acros.

Example 2: Reactor Setup

The experiments were conducted in an Inconel batch reactor (100 cm3 internal volume) obtained from Parr Instrument Company (p/n 4590 micro). The reactor was equipped with gas inlet and release valves, a 0-35 MPa pressure gauge (p/n 593HCP50AD), a thermocouple (p/n A472E2), a Parr magnetic drive and impeller (p/n A1120HC6), and a rupture disk (p/n 526HCP50CTYZ50). Heating was provided by an electric heater (Parr Instrument, p/n A3240HC6EB), and temperature was controlled by a PID controller (Parr Instrument, p/n 4848) with a precision of ±0.5° C. The reaction temperature was set to 400° C. in the reactor. The reaction pressure, measured by a Bourdon-tube pressure gauge, was maintained between 22 and 26 MPa. These conditions exceed the critical temperate and pressure of pure water (374° C. and 22.1 MPa) and pure dodecane (384° C. and 1.86 MPa), and they were selected to ensure a single-phase reaction mixture.

Example 3: Reaction Protocol

Experiments were performed to obtain rate data in the presence and absence of water and ethanol using mixtures detailed in Table I. The mass loading of the catalyst was maintained at 5% with respect to the initial dodecane mass. Since both the water solvent and dodecane reactant are at supercritical conditions in the reaction mixture, they are referred to as supercritical water (SCW) and supercritical dodecane (SCD).

After reactor loading and prior to each test, the reactor mass was measured to within ±0.5 g. The reactor was then purged with helium 5 times to 3.5 MPa to remove residual air in the headspace and connections. Depending on the feed, between 0.3 to 3.0 MPa of He was then added to the reactor to ensure that all reactions proceeded at a consistent pressure of 24±2 MPa. The reactor was weighed again to determine the mass of added He. During the reaction, the reactor was mixed with a magnetic drive (160 rpm). After reaction time was achieved, the reactor was rapidly quenched (<1 min) by submerging the reactor into a water-ice bath (~2 L volume). Reaction times are reported based on the time spent at 400° C.; experiments performed at "0 hours" therefore refer to heating the reactor to 400° C. followed by immediate quenching.

Example 4: Gas Product Analysis

After reaction quenching, the reactor was weighed and compared with its initial mass to evaluate mass balance closure. Based on the precision of the analytical balance (±0.5 g), the overall product (liquid and gas) mass balance closure was determined to be >97% for each run. After collecting a gas sample for composition analysis, the remaining gas was evacuated from the reactor and the reactor was weighed again to determine the gravimetric gas yield by difference.

Gas composition was determined using a gas chromatograph (GC-2014 Shimadzu system) equipped with a thermal conductivity detector and an 80/100 Hayesep Q packed column (3×m×0.125 in×2.1 mm SS). Helium was the carrier gas with a flow rate of 10 sccm. The initial column temperature was 30° C., which was increased by 5° C. min−1 to reach 90° C. and then maintained at 90° C. for 20 min for product elution. To remove nonvolatile residues, the temperature was increased from 90° C. to 130° C. at 5° C. min−1, then to 150° C. at 10° C. min−1, and then maintained at 150° C. for 20 min. During the entire run, the TCD temperature was 150° C. and the current was set to 120 mA. Elution times and response factors were determined for CO, CO2, CH4, C2H4 and C3H6, C3H8 and C4H10 using calibration standards.

Example 5: Liquid Oil Product Analysis

Liquid yield was calculated by subtracting gas yield and solid yield from the overall mass balance. All experiments were performed at least twice and mass yields agreed to within ±5% in all cases. Average values are reported here after normalization to the initial mass of dodecane reactant to arrive at product yields as grams per gram of feed (g g−1).

For liquid product identification, the recovered oil was diluted ~100 times in dichloromethane and analyzed using a GC equipped with a mass spectrometer detector (QP 2010 SE system, Shimadzu) and a SHRXI-5MS column (30 m×0.25 mm ID×0.5 μm film thickness). Helium was the carrier gas (2 sccm). The initial column temperature was 40° C., which was increased by 3° C. min−1 until reaching a maximum temperature of 300° C. The injector temperature was held at 300° C. and the injected sample volume was 1 μL. Subsequent to product identification, the oil phase was analyzed to quantify product yields using a GC equipped with a flame ionization detector (Shimadzu) and Rt-Q-BOND column (30 m×0.25 mm ID×8 μm film thickness). The same temperature program and sample volume were used for both GC-FID and GC-MS analysis.

Individual product yields were quantified using GC-FID response factors for octane, decane, dodecane, toluene, ethylbenzene, p-xylene, 1,2,4-trimethyl benzene, and naphthalene, etc. as representative products. Response factors for representative products were generalized to reaction products identified by GC-MS using composition-based methods reported in the literature40. As a consistency check, the total mass yield of oil was estimated by summing the masses of individual components determined using GC-FID and compared with the oil yield determined gravimetric ally.

In most cases, the sum of individual products present in the oil phase agreed with the gravimetric oil yield to within ±3%, our previously stated uncertainty. In some cases, the oil yield determined by summation of the individual components was between 5 and 20% less than the gravimetric oil yield. This mass balance gap was attributed to production of nonvolatile/low vapor pressure products that could not be detected using GC. In cases where the mass balance gap was greater than 10%, oil samples were evaporated to dryness, and the residual mass was determined gravimetrically. The sum of GC-quantified oils and residue again agreed with the total gravimetric yield to within ±3%.

Example 6: Solid Product Characterization

The solid product was separated by filtration and rinsed with dichloromethane until the effluent solution became colorless. The solid product was then dried at 100° C. for 3 h to remove residual solvent. The total solid product yield, which included both ZSM-5 and coke, was determined gravimetrically. The coke yield was determined by analyzing residual solids using temperature programmed oxidation with a TGA 209 F1 Libra from Netzch (temperature program of 30-800° C. with a rate of 10° C. min−1 and a mixture of oxygen, 4 sccm, and nitrogen, 8 sccm). Coke was differentiated from ZSM-5 as the difference between the total solid mass and the mass of solid remaining after reaching 600° C.

What is claimed is:

1. A method for producing at least one petrochemical product, the method comprising:

preparing a reaction mixture by adding at least two of: a quantity of bioethanol, a quantity of hydrocarbon, and a quantity of water to a reactor containment;

combining the reaction mixture with a quantity of catalyst in the reactor containment;

applying reaction conditions to the reactor containment thereby generating supercritical conditions for the reaction mixture and obtaining a product mixture; and extracting at least one petrochemical product from the product mixture, the reaction conditions producing a higher quantity of petrochemical product compared to a reaction not comprising water or ethanol and otherwise identical.

2. The method according to claim 1 further comprising removing from the reactor containment at least one residual product.

3. The method according to claim 2, the residual product comprises at least one of: water, catalyst, and unreacted hydrocarbon.

4. The method according to claim 2 further comprising reusing the residual product for subsequent reaction.

5. The method according to claim 1, the reaction conditions result in reducing formation of coke compared to a reaction not comprising water or ethanol.

6. The method according to claim 1, the petrochemical product comprises aromatic products.

7. The method according to claim 6, the aromatic products are selected from: benzene, toluene, ethylbenzene, xylene, $C_9$ aromatic products, $C_{10}$ aromatic products, $C_{11}$ aromatic products, $C_{12}$ aromatic products, and alkyl-naphthalene.

8. The method according to claim 6, the petrochemical products comprise aliphatic products selected from: n-alkane, n-alkene, b-alkane, b-alkene, cyclo-alkane, and cyclo-alkene.

9. The method according to claim 1, the catalyst is a zeolite catalyst.

10. The method according to claim 9, the zeolite catalyst is at least one selected from: Zeolite Socony Mobil-5 (ZSM-5), nano-ZSM-5, zeolite Y, zeolite β, mordenite, $Fe_2O_3$ (HY), ferrierite, and MCM-22.

11. The method according to claim 1, the quantity of the catalyst is selected from 1.0 wt % to 10.0 wt %.

12. The method according to claim 1, the quantity of bioethanol is selected from: 1.0 wt % to to 10.0 wt %.

13. The method according to claim 1, the quantity of water is selected from: 1.0 wt % to 10.0 wt %.

14. A method for upgrading hydrocarbon feedstock to produce at least one petrochemical product, the method comprising:

preparing a reaction mixture by adding 5 wt % bioethanol, 90 wt % hydrocarbon, and 5 wt % water to a reactor containment;

combining the reaction mixture with 5 wt % catalyst selected from ZSM-5 or nano-ZSM-5 in the reactor containment;

applying reaction conditions to the reactor containment thereby generating supercritical conditions for the reaction mixture and obtaining a product mixture, the reaction conditions result in lower quantity of unreacted hydrocarbon and coke compared to a reaction not comprising water or ethanol and otherwise identical; and extracting at least one petrochemical product from the product mixture.

* * * * *